US009889905B2

(12) United States Patent
Albertson

(10) Patent No.: US 9,889,905 B2
(45) Date of Patent: Feb. 13, 2018

(54) UNDERWATER OBJECT RETRIEVAL DEVICE

(71) Applicant: Kurtis Albertson, Bothell, WA (US)

(72) Inventor: Kurtis Albertson, Bothell, WA (US)

( * ) Notice: Subject to any disclaimer, the term of this patent is extended or adjusted under 35 U.S.C. 154(b) by 0 days.

(21) Appl. No.: 15/152,547

(22) Filed: May 12, 2016

(65) Prior Publication Data

US 2017/0327189 A1 Nov. 16, 2017

(51) Int. Cl.
*B63B 21/16* (2006.01)
*B66D 1/60* (2006.01)
*B63B 22/22* (2006.01)

(52) U.S. Cl.
CPC ..... *B63B 21/16* (2013.01); *B63B 22/22* (2013.01); *B66D 1/60* (2013.01)

(58) Field of Classification Search
CPC ..... B63B 21/16
USPC ..... 441/22
See application file for complete search history.

(56) References Cited

U.S. PATENT DOCUMENTS 3,848,226 A * 11/1974 Perez ..... B63C 7/26 294/66.1
4,262,379 A * 4/1981 Jankiewicz ..... A01K 69/08 102/406
4,860,487 A * 8/1989 Kingston ..... B63B 22/22 114/331
4,980,989 A 1/1991 Davis
5,022,013 A * 6/1991 Dalton ..... B63B 22/06 367/4
D344,318 S 2/1994 Steinman
5,782,663 A * 7/1998 Van Raden ..... B63B 22/18 441/25
6,261,142 B1 * 7/2001 Fiotakis ..... A01K 69/06 441/11
6,383,045 B1 * 5/2002 Eckardt ..... B63B 22/18 440/16
6,739,924 B1 * 5/2004 Groen ..... B63B 22/04 441/2
6,880,290 B2 * 4/2005 Mahoney ..... A01K 69/00 43/100
8,167,670 B1 * 5/2012 Gibson ..... B63B 22/06 114/336
8,206,193 B2 * 6/2012 Tjom ..... B63B 22/06 441/11
2007/0264890 A1 * 11/2007 Brown ..... A01K 69/00 441/30

(Continued)

*Primary Examiner* — Lars A Olson
*Assistant Examiner* — Jovon Hayes

(57) ABSTRACT

An underwater object retrieval device for selective deployment to retrieve underwater objects includes an inflation unit that is configured to inflate upon command. A coupler is configured for coupling to an object to be placed underwater. A tether line has a first end, which is coupled to the inflation unit, and a second end, which is coupled to the coupler. A line storage unit is coupled to the tether line proximate to the second end. The line storage unit is positioned to house the tether line, such that the tether line is extensible from the line storage unit. The inflation unit is positioned to inflate upon user directed command, such that the inflation unit is buoyant. The tether line is extended from the line storage unit, such that the inflation unit reaches the water surface. The tether line is configured for retrieving the object to the surface.

16 Claims, 5 Drawing Sheets

(56) References Cited

U.S. PATENT DOCUMENTS

2013/0109257 A1* 5/2013 Abulrassoul ..... A01K 69/06
441/2

* cited by examiner

UNDERWATER OBJECT RETRIEVAL DEVICE

BACKGROUND OF THE DISCLOSURE

Field of the Disclosure

The disclosure relates to retrieval devices and more particularly pertains to a new retrieval device for selective deployment to retrieve underwater objects.

SUMMARY OF THE DISCLOSURE

An embodiment of the disclosure meets the needs presented above by generally comprising an inflation unit that is configured to inflate upon command. A coupler is configured for coupling to an object to be placed underwater. A tether line has a first end, which is coupled to the inflation unit, and a second end, which is coupled to the coupler. A line storage unit is coupled to the tether line proximate to the second end. The line storage unit is positioned to house the tether line, such that the tether line is extensible from the line storage unit. The inflation unit is positioned to inflate upon user directed command, such that the inflation unit is buoyant. The tether line is extended from the line storage unit, such that the inflation unit reaches the water surface. The tether line is configured for retrieving the object to the surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
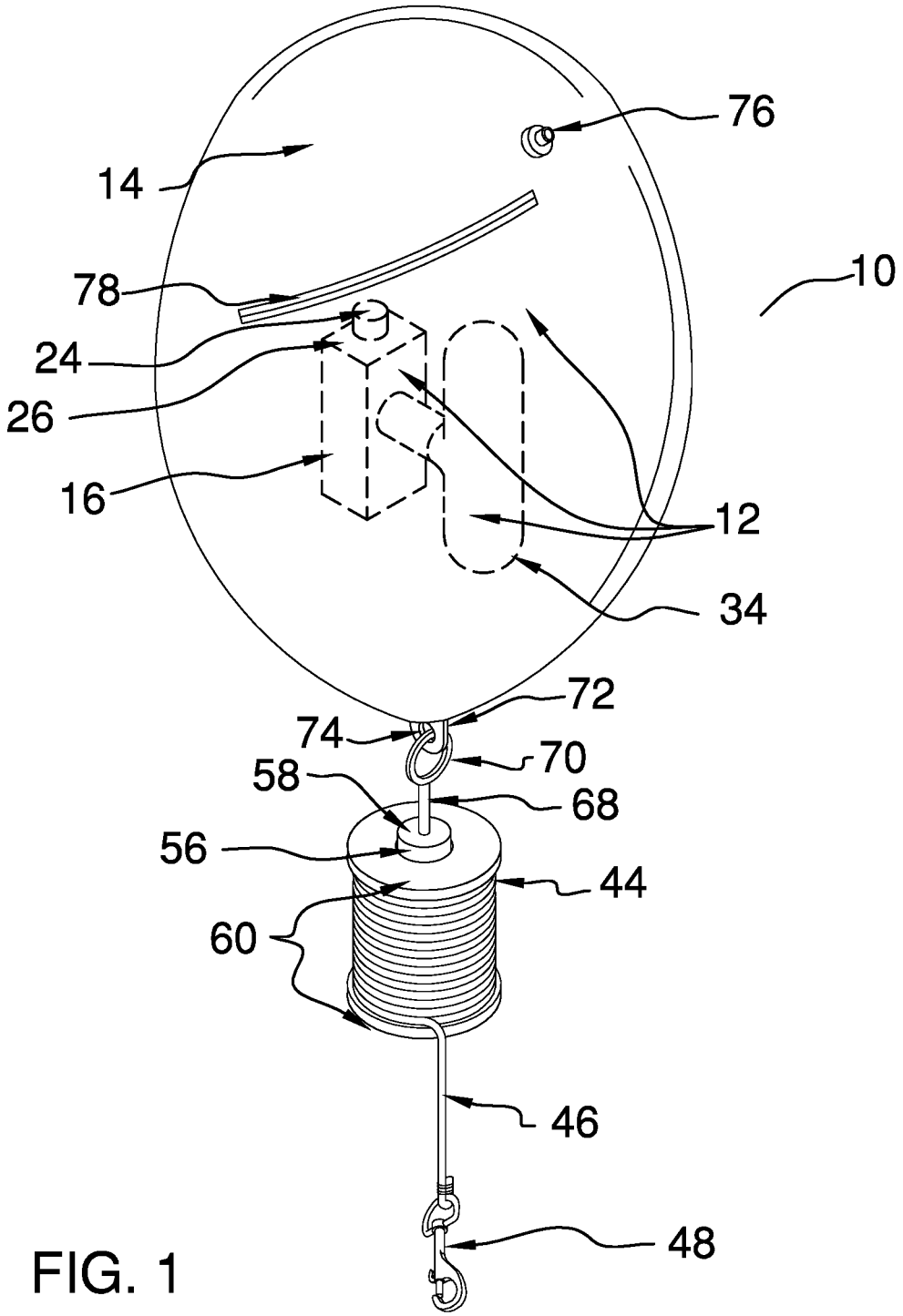
FIG. 1 is an isometric perspective view of an underwater object retrieval device according to an embodiment of the disclosure.
Figure 2:
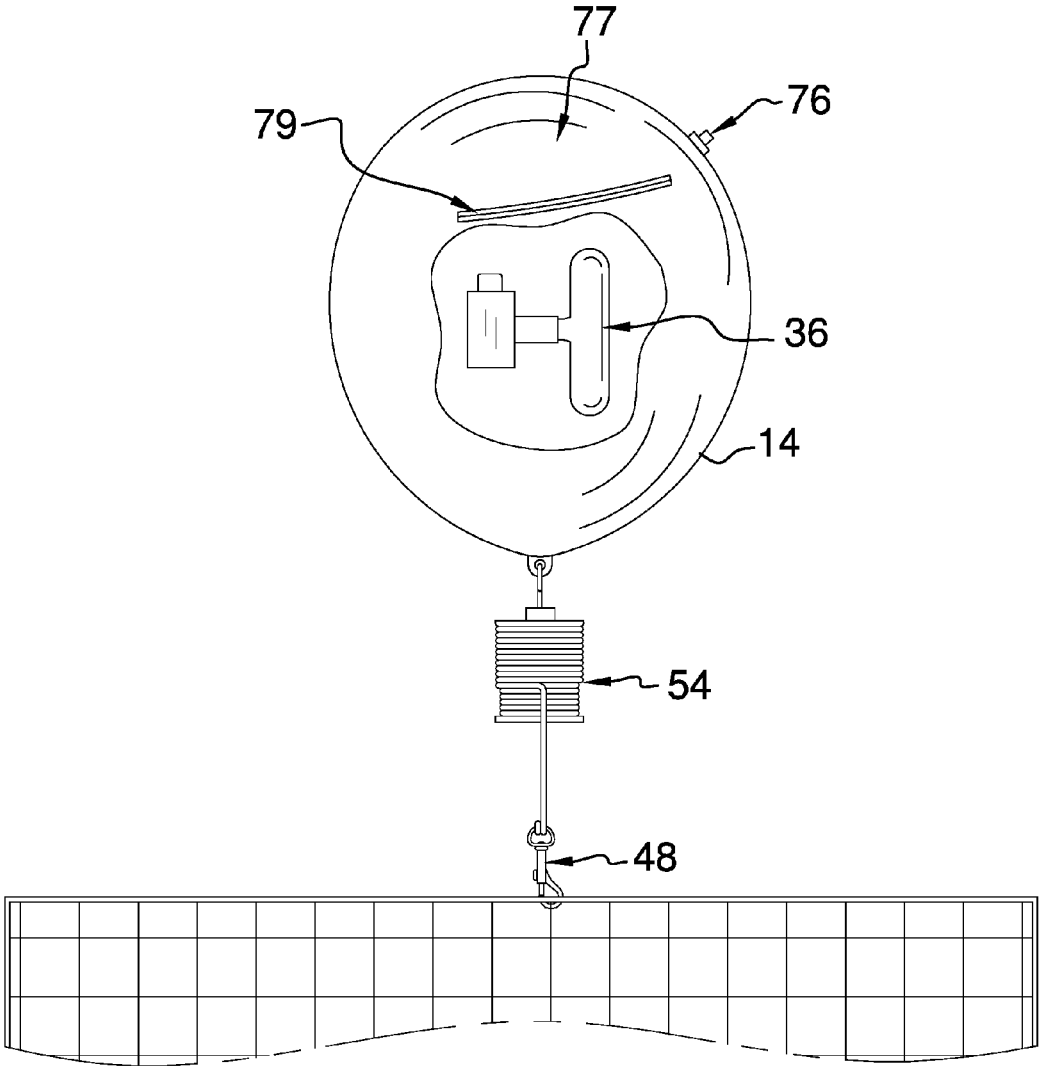
FIG. 2 is a front view of an embodiment of the disclosure.
Figure 3:
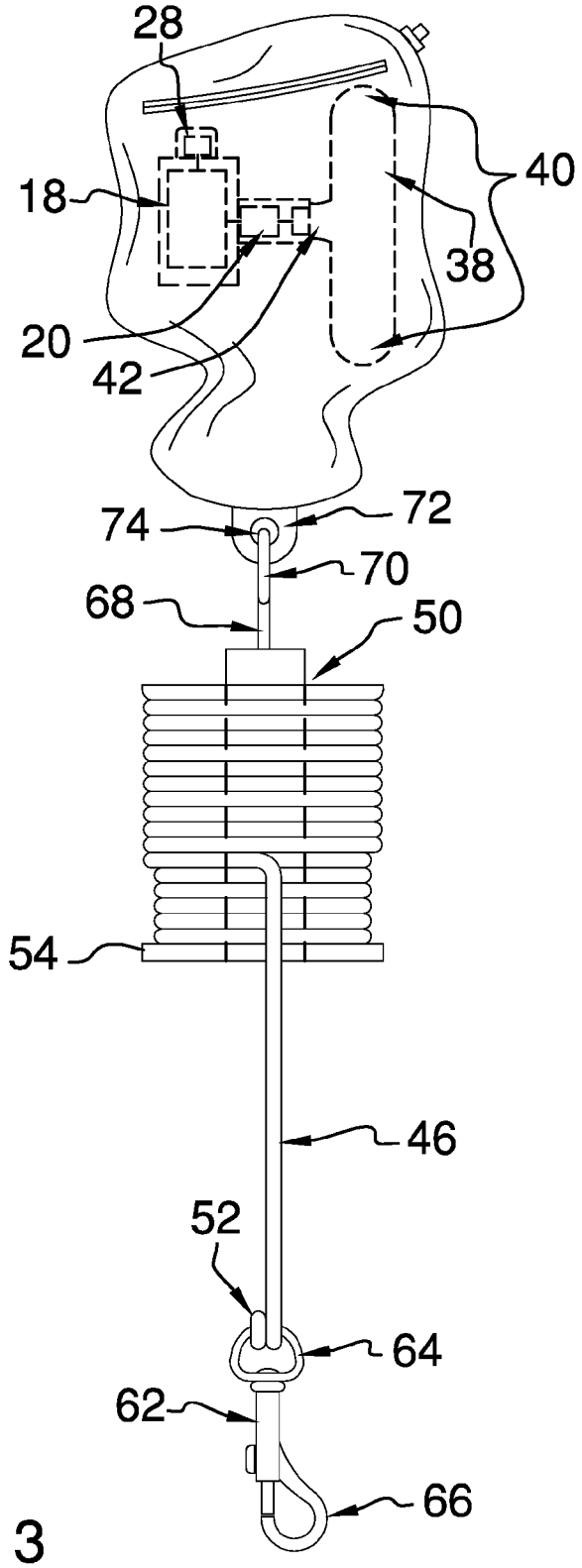
FIG. 3 is a front view of an embodiment of the disclosure.
Figure 4:
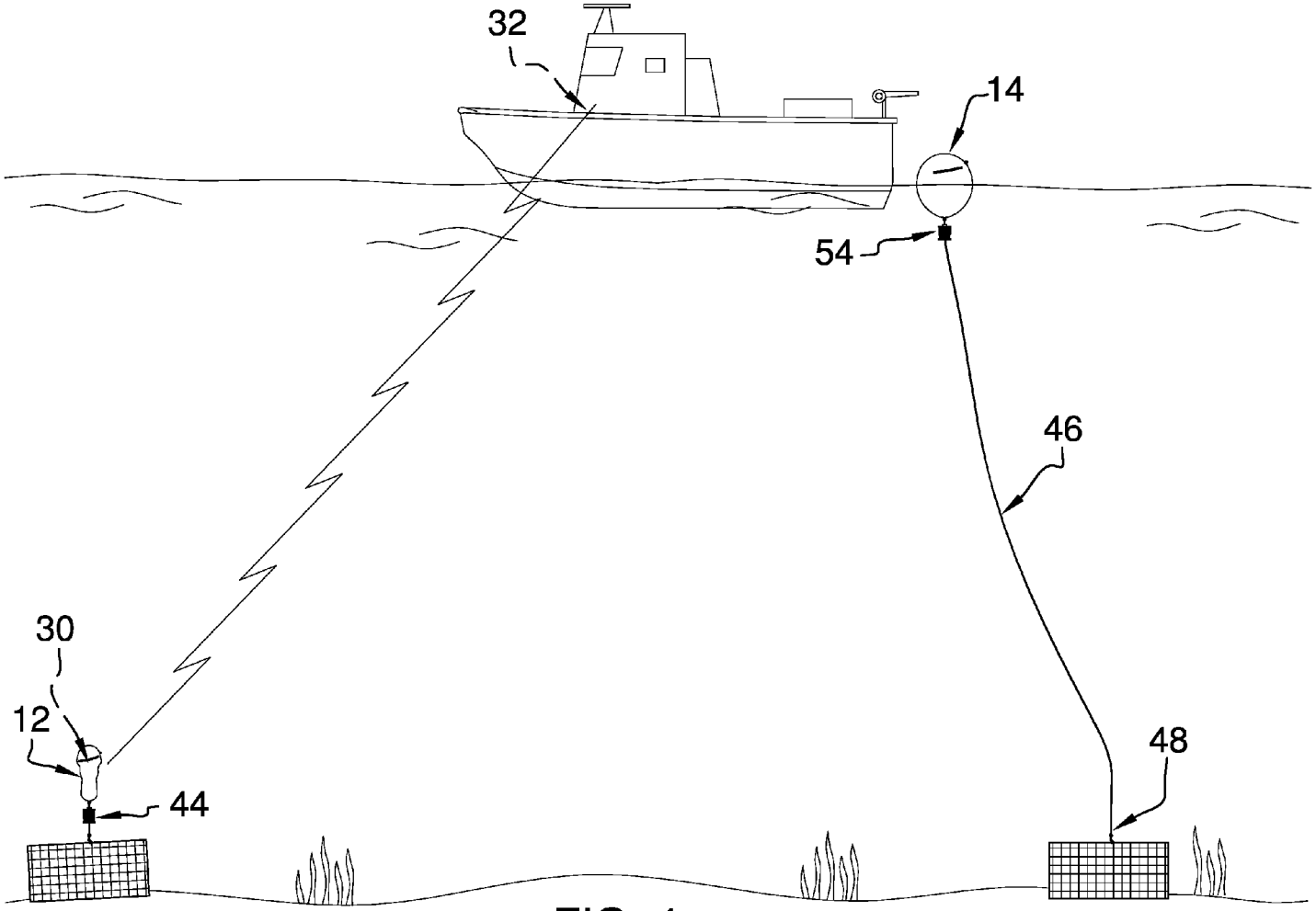
FIG. 4 is an in-use view of an embodiment of the disclosure.
Figure 5:
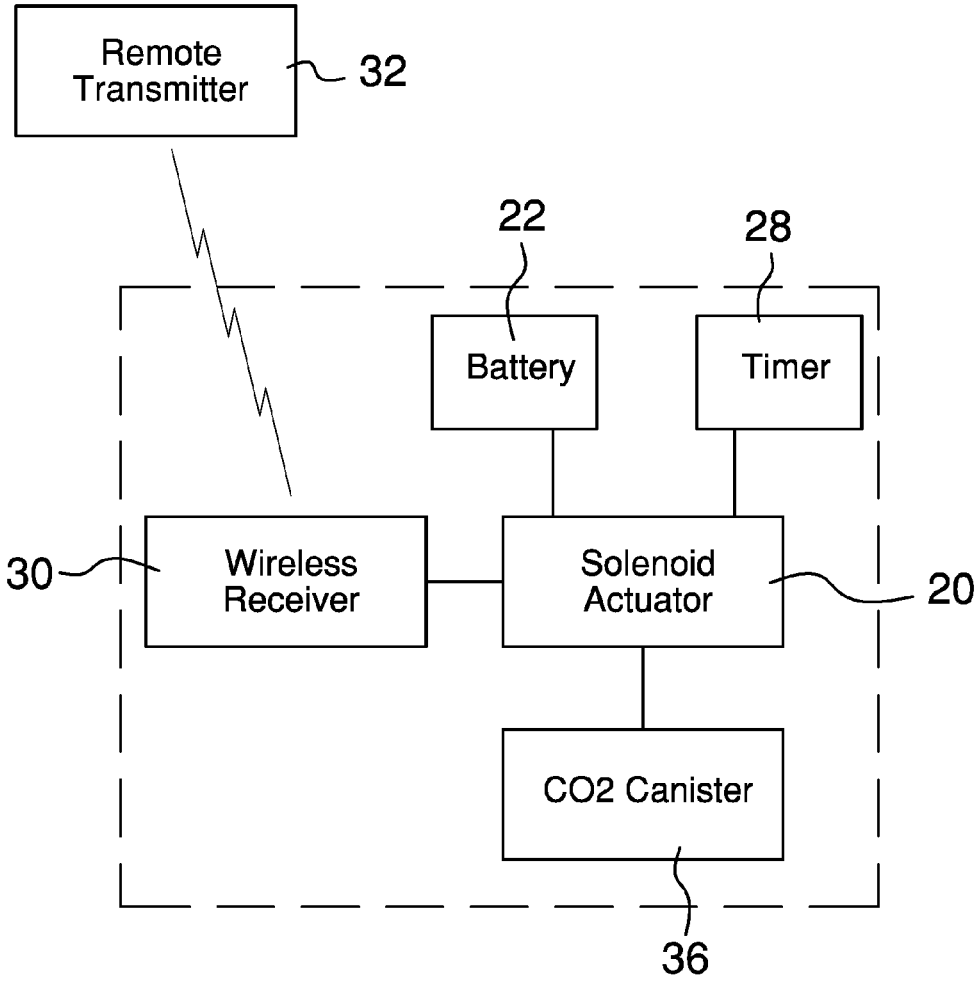
FIG. 5 is a block diagram of an embodiment of the disclosure.

With reference now to the drawings, and in particular to FIGS. 1 through 5 thereof, a new retrieval device embodying the principles and concepts of an embodiment of the disclosure and generally designated by the reference numeral 10 will be described.

As best illustrated in FIGS. 1 through 5, the underwater object retrieval device 10 generally comprises an inflation unit 12 that is configured to inflate upon command. More specifically, the inflation unit 12 comprises a bag 14 that is selectively inflatable. A safety valve 16 is positioned through and coupled to a wall 18 of the bag 14. The safety valve 16 is positioned in the wall 18 such that the pressure in the bag 14 does not exceed a pressure allowed by the safety valve 16. A deflater 20 is positioned in and coupled to the wall 18 of the bag 14. The deflater 20 is positioned in the wall 18 such that the bag 14 is deflatable. Preferably, the deflater 20 comprises a resealable opening 22 positioned in the wall 18.

A housing 24, which is watertight, is coupled to the bag 14. Preferably, the housing 24 is substantially rectangularly box shaped. A power storage module 26 is positioned in and coupled to the housing 24. Preferably, the power storage module 26 comprises at least one battery 28. An actuator 30 is positioned in and coupled to the housing 24. The actuator 30 is fluidically coupled to the bag 14 and operationally coupled to the power storage module 26. An effector unit 32 is coupled to the housing 24. Preferably, the effector unit 32 is coupled to an upper face 34 of the housing 24. The effector unit 32 is operationally coupled to the actuator 30, such that the effector unit 32 is positioned to motivate the actuator 30.

In one embodiment of the invention, the effector unit 32 comprises a timer 36. The timer 36 is operationally coupled to the actuator 30. The timer 36 is configured to be set by the user such that the timer 36 motivates the actuator 30 at a preset time. In another embodiment, the effector unit 32 comprises a receiver 38 and a transmitter 40. The receiver 38 is coupled to the housing 24 and operationally coupled to the actuator 30. The transmitter 40 is wirelessly coupled to the receiver 38. The transmitter 40 is positioned to signal the receiver 38 to motivate the actuator 30.

A reservoir 42 is sealably and fluidically couplable to the actuator 30. The reservoir 42 is configured for storage of compressed gas. Preferably, the reservoir 42 comprises a tank 44. The tank 44 comprises a cylinder 46 that has opposing ends 48, which preferably are rounded. A neck 50 is coupled to a respective opposing end 48. The neck 50 is threaded, such that the neck 50 is threadedly couplable to the actuator 30.

The device 10 comprises a coupler 52 and a tether line 54. The coupler 52 is configured for coupling to an object to be placed underwater. The tether line 54 has a first end 56 and a second end 58. The first end 56 is coupled to the inflation unit 12 and the second end 58 is coupled to the coupler 52. Preferably, the coupler 52 comprises a clip 60. The clip 60 comprises a loop end 62 and a snap end 64. The loop end 62 is positioned to couple to the second end 58 of the tether line 54 and the snap end 64 is configured for attachment to the object to be placed underwater.

A line storage unit 66 is coupled to the tether line 54 proximate to the second end 58. The line storage unit 66 is positioned to house the tether line 54, such that the tether line 54 is extensible from the line storage unit 66. Preferably, the line storage unit 66 comprises a spool 68. The spool 68 comprises a hub 70 and a pair of flanges 72. The hub 70 is substantially cylindrically shaped and has opposing endpoints 74. Each flange 72 is coupled to the hub 70 proximate to a respective opposing endpoint 74. The hub 70 is positioned for winding of the tether line 54, such that the tether line 54 is retained around the hub 70 between the flanges 72.

The tether line 54 may comprise a first segment 75 and a second segment 76. The first segment 75 comprises the first end 56 of the tether line 54 and a first terminus 77. The first terminus 77 is coupled to the line storage unit 66. The second segment 76 comprises the second end 58 of the tether line 54 and a second terminus 78. The second terminus 78 is coupled to the line storage unit 66.

In use, the inflation unit 12 is coupled using the coupler 52 to the object to be placed underwater for later recovery. The timer 36 may be used to set a time point when the actuator 30 will be engaged. Alternatively, the user may employ the transmitter 40 to signal the receiver 38 to motivate the actuator 30. The actuator 30 is coupled to the reservoir 42, which contains a compressed gas such as carbon dioxide. Upon motivation by the effector unit 32, the actuator 30 motivates gas to expand into the bag 14. The bag 14 becomes buoyant and induces the tether line 54 to unspool from the spool 68 until the bag 14 reaches the surface. The tether line 54 is configured for retrieving the object to the surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A selectively deployable underwater object retrieval device comprising:

an inflation unit, wherein said inflation unit is configured to inflate upon command, said inflation unit comprising a bag, said bag being selectively inflatable, a housing, said housing being coupled to said bag, said housing being watertight, a power storage module, said power storage module being positioned in and coupled to said housing, an actuator, said actuator being positioned in and coupled to said housing, said actuator being operationally coupled to said power storage module, said actuator being fluidically coupled to said bag, an effector unit, said effector unit being coupled to said housing, said effector unit being operationally coupled to said actuator, wherein said effector unit is positioned to motivate said actuator, and a reservoir, said reservoir being sealably and fluidically couplable to said actuator, said reservoir being configured for storage of compressed gas;

a coupler, said coupler being configured for coupling to an object to be placed underwater;

a tether line, said tether line having a first end and a second end, said first end being coupled to said inflation unit, said second end being coupled to said coupler;

a line storage unit, said line storage unit being coupled to said tether line proximate to said second end, wherein said line storage unit is positioned to house said tether line, such that said tether line is extensible from said line storage unit;

wherein said inflation unit is positioned to inflate upon user directed command, such that said inflation unit is buoyant and wherein said tether line is extended from said line storage unit, such that said inflation unit reaches the water surface, and wherein said tether line is configured for retrieving the object to the surface; and a safety valve, said safety valve being positioned through and coupled to a wall of said bag, wherein said safety valve is positioned in said wall such that the pressure in said bag does not exceed a pressure allowed by said safety valve.

2. The device of claim 1, further including said housing being substantially rectangularly box shaped.

3. The device of claim 1, further including said power storage module comprising at least one battery.

4. The device of claim 1, further including said effector unit comprising a timer, said timer being operationally coupled to said actuator, wherein said timer is configured to be set by the user such that said timer motivates said actuator at a preset time.

5. The device of claim 1, further including said effector unit comprising:

a receiver, said receiver being coupled to said housing, said receiver being operationally coupled to said actuator;

a transmitter, said transmitter being wirelessly coupled to said receiver; and wherein said transmitter is positioned to signal said receiver to motivate said actuator.

6. The device of claim 1, further including said effector unit being coupled to an upper face of said housing.

7. The device of claim 1, further including said reservoir comprising a tank.

8. The device of claim 7, further including said tank comprising:

a cylinder, said cylinder having opposing ends, said opposing ends being rounded;

a neck, said neck being coupled to a respective said opposing end, said neck being threaded; and wherein said neck is threadedly couplable to said actuator.

9. The device of claim 1, further including A selectively deployable underwater object retrieval device comprising:

an inflation unit, wherein said inflation unit is configured to inflate upon command, said inflation unit comprising a bag, said bag being selectively inflatable, a housing, said housing being coupled to said bag, said housing being watertight, a power storage module, said power storage module being positioned in and coupled to said housing, an actuator, said actuator being positioned in and coupled to said housing, said actuator being operationally coupled to said power storage module, said actuator being fluidically coupled to said bag, an effector unit, said effector unit being coupled to said housing, said effector unit being operationally coupled to said actuator, wherein said effector unit is positioned to motivate said actuator, and a reservoir, said reservoir being sealably and fluidically couplable to said actuator, said reservoir being configured for storage of compressed gas;

a coupler, said coupler being configured for coupling to an object to be placed underwater;

a tether line, said tether line having a first end and a second end, said first end being coupled to said inflation unit, said second end being coupled to said coupler;

a line storage unit, said line storage unit being coupled to said tether line proximate to said second end, wherein said line storage unit is positioned to house said tether line, such that said tether line is extensible from said line storage unit;

wherein said inflation unit is positioned to inflate upon user directed command, such that said inflation unit is buoyant and wherein said tether line is extended from said line storage unit, such that said inflation unit reaches the water surface, and wherein said tether line is configured for retrieving the object to the surface; and a deflater, said deflater being positioned in and coupled to said wall of said bag, wherein said deflater is positioned in said wall such that said bag is deflatable.

10. The device of claim 9, further including said deflater comprising a resealable opening positioned in said wall.

11. The device of claim 1, further including said coupler comprising a clip.

12. The device of claim 11, further including said clip comprising a loop end and a snap end, wherein said loop end is positioned to couple to said second end of said tether line and said snap end is configured for attachment to the object.

13. The device of claim 1, further including said line storage unit comprising a spool.

14. The device of claim 13, further including said spool comprising:

a hub, said hub being substantially cylindrically shaped, said hub having opposing endpoints;

a pair of flanges, each said flange being coupled to said hub proximate to a respective said opposing endpoint; and wherein said hub is positioned for winding of said tether line, such that said tether line is retained around said hub between said flanges.

15. The device of claim 1, further including said tether line comprising:

a first segment, said first segment comprising said first end and a first terminus, said first terminus being coupled to said line storage unit; and a second segment, said second segment comprising said second end and a second terminus, said second terminus being coupled to said line storage unit.

16. A selectively deployable underwater object retrieval device comprising:

an inflation unit, wherein said inflation unit is configured to inflate upon command, said inflation unit comprising:

a bag, said bag being selectively inflatable, a housing, said housing being coupled to said bag, said housing being watertight, said housing being substantially rectangularly box shaped, a power storage module, said power storage module being positioned in and coupled to said housing, said power storage module comprising at least one battery, an actuator, said actuator being positioned in and coupled to said housing, said actuator being operationally coupled to said power storage module, said actuator being fluidically coupled to said bag, an effector unit, said effector unit being coupled to said housing, said effector unit being coupled to an upper face of said housing, said effector unit being operationally coupled to said actuator, wherein said effector unit is positioned to motivate said actuator, said effector unit comprising a timer, said timer being operationally coupled to said actuator, wherein said timer is configured to be set by the user such that said timer motivates said actuator at a preset time, said effector unit comprising:

a receiver, said receiver being coupled to said housing, said receiver being operationally coupled to said actuator, a transmitter, said transmitter being wirelessly coupled to said receiver, and wherein said transmitter is positioned to signal said receiver to motivate said actuator, a reservoir, said reservoir being sealably and fluidically couplable to said actuator, said reservoir being configured for storage of compressed gas, said reservoir comprising a tank, said tank comprising:

a cylinder, said cylinder having opposing ends, said opposing ends being rounded, and a neck, said neck being coupled to a respective said opposing end, said neck being threaded, wherein said neck is threadedly couplable to said actuator, a safety valve, said safety valve being positioned through and coupled to a wall of said bag, wherein said safety valve is positioned in said wall such that the pressure in said bag does not exceed a pressure allowed by said safety valve, and a deflater, said deflater being positioned in and coupled to said wall of said bag, wherein said deflater is positioned in said wall such that said bag is deflatable, said deflater comprising a resealable opening positioned in said wall;

a coupler, said coupler being configured for coupling to an object to be placed underwater, said coupler comprising a clip, said clip comprising a loop end and a snap end, wherein said loop end is positioned to couple to said second end of said tether line and said snap end is configured for attachment to the object;

a tether line, said tether line having a first end and a second end, said first end being coupled to said inflation unit, said second end being coupled to said coupler;

a line storage unit, said line storage unit being coupled to said tether line proximate to said second end, wherein said line storage unit is positioned to house said tether line, such that said tether line is extensible from said line storage unit, said line storage unit comprising a spool, said spool comprising:

a hub, said hub being substantially cylindrically shaped, said hub having opposing endpoints, a pair of flanges, each said flange being coupled to said hub proximate to a respective said opposing endpoint, and wherein said hub is positioned for winding of said tether line, such that said tether line is retained around said hub between said flanges;

said tether line comprising a first segment and a second segment, said first segment comprising said first end and a first terminus, said first terminus being coupled to said line storage unit, said second segment comprising said second end and a second terminus, said second terminus being coupled to said line storage unit; and wherein said inflation unit is positioned to inflate, such that said inflation unit is buoyant and wherein said tether line is extended from said line storage unit, such that said inflation unit reaches the water surface, and wherein said tether line is configured for retrieving the object to the surface.

* * * * *